US006148580A

United States Patent [19]

Weir

[11] Patent Number: 6,148,580

[45] Date of Patent: Nov. 21, 2000

[54] SAFETY FRAME

[76] Inventor: Richard L. Weir, 17513 Roxbury Ave., Southfield, Mich. 48075

[21] Appl. No.: 09/120,109

[22] Filed: Jul. 21, 1998

Related U.S. Application Data

[60] Provisional application No. 60/059,970, Sep. 25, 1997.

[51] Int. Cl.[7] ..... A47L 3/04; E04G 3/14

[52] U.S. Cl. ..... 52/651.1; 182/3; 182/36

[58] Field of Search ..... 52/651.1, 651.11, 52/653.2, 656.1; 182/3, 36, 39, 38

[56] References Cited

U.S. PATENT DOCUMENTS

| | | | |
|---|---|---|---|
| 2,871,915 | 2/1959 | Hogan | 482/69 |
| 3,379,439 | 4/1968 | Sorenson et al. | 482/25 |
| 4,607,724 | 8/1986 | Hillberg | 182/3 |
| 4,699,245 | 10/1987 | Benedet | 182/3 |
| 5,143,170 | 9/1992 | Hunt et al. | 182/3 |
| 5,285,868 | 2/1994 | Amacker | 182/134 |
| 5,522,472 | 6/1996 | Shuman, Jr. et al. | 182/3 |
| 5,537,933 | 7/1996 | Ablad | 105/457 |

*Primary Examiner*—Christopher T. Kent
*Assistant Examiner*—Jennifer I. Thissell
*Attorney, Agent, or Firm*—Plunkett & Cooney, P.C.

[57] ABSTRACT

In a first embodiment of the invention, a safety frame comprises at least four legs; a pair of spaced apart beams, each connected to two of the legs; and at least one cross-beam extending between and secured to the pair of spaced apart beams. At least one traveler is slidably disposed on the at least one cross-beam. A tethering device, such as a lanyard, may be secured to the traveler, and a safety jacket may be secured to the tethering device. A worker wearing a safety jacket secured to a tethering device that is secured to the traveler is both protected against falls and has a wide field of movement as the traveler moves along the at least one cross-beam. The safety frame is rendered movable by casters secured to the legs. Insert members render the legs extensible beyond the height of the casters to render the safety frame fixable in position. In a second embodiment of the invention, the safety frame of the first embodiment is modified by having each of the legs pivotably secured to a base member, both directly and indirectly via a bracing member, rather than having insert members and casters. The base members are affixable to a surface, such as a roof or the like, if desired. The cross-beams are secured to the legs, rather than to beams that are secured to the legs.

16 Claims, 3 Drawing Sheets

FIG 3
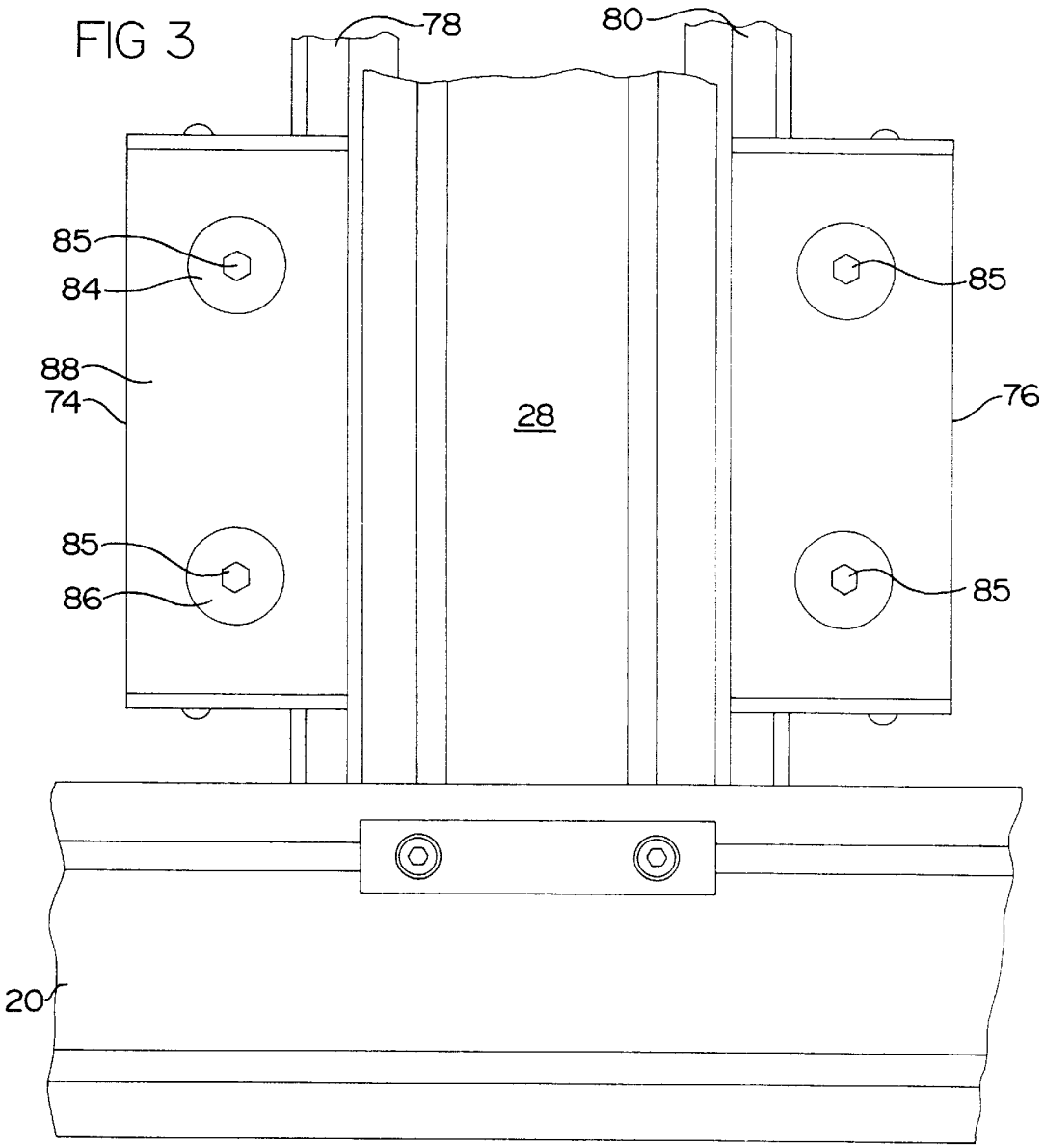
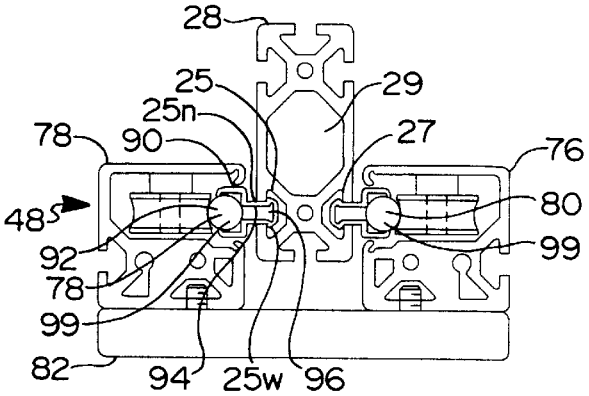
FIG 4

SAFETY FRAME

CROSS-REFERENCE TO RELATED APPLICATION

This application claims the benefit of U.S. Provisional Application Ser. No. 60/059,970, filed Sep. 25, 1997, the disclosure of which is incorporated by reference.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to safety devices used during building construction, maintenance, and repair. More particularly, the present invention relates to safety devices used by workers to secure themselves during building construction, maintenance, and repair. Even more particularly, the present invention relates to safety devices that can be used by more than one worker concurrently to secure themselves from falls through open spaces or from roofs or other edges during building construction, maintenance, and repair.

2. Prior Art

The Occupational Safety and Health Administration, as well as common sense, requires that workers near a hazardous open space be protected against possible falls into the open space. For instance, roofers must be secured against falling off the roof, or, if working near a hole in the roof, against falling into the hole. A technique widely used today in the construction industry involves securing a length of rope to a worker at one end and to a stanchion of some sort at the other end, the stanchion being attached to a surface such as a roof being worked on. These ropes frequently become tangled, caught by other workers or equipment, or cut, thus increasing both danger and inconvenience to the worker while reducing comfort and productivity because of having to work around the ropes.

Several patents have addressed the idea of directly or indirectly tethering a person to a frame or other device to prevent falls. These have been directed to the medical, gymnastic, railroad, and construction fields, as described hereinbelow. For example, U.S. Pat. No. 2,871,915, issued Feb. 3, 1959 to Hogan, is entitled "ORTHOPEDIC DEVICE." The patent teaches an orthopedic device comprising a load-bearing frame with four telescoping legs connected at their tops by side rails. A lockable caster is attached to each leg. The top is rectangular in shape. A track formed by a pair of cooperating beams extends between the short side rails intermediate the long side rails. A chain, driven by a motor, seats in the track. A body harness is attached to the chain. In use, a person is placed in the body harness, the height of the legs is adjusted, and the person walks along the frame supported by the body harness and pulled by the motor.

U.S. Pat. No. 3,379,439, issued Apr. 23, 1968 to Sorenson et al., is entitled "SIDE HORSE TRAINING DEVICE." The patent teaches a training device comprising a gymnastic "side horse" device and a load-bearing frame suspended above the side horse from cables attached to a ceiling of a room. The frame is movable on the cables. A body harness is attached to, and movable on, the frame. In use, a person is attached to the body harness to facilitate more efficacious use of the side horse.

U.S. Pat. No. 4,607,724, issued Aug. 26, 1986 to Hillberg, is entitled "SAFETY APPARATUS FOR ROOFERS." The patent teaches a safety apparatus comprising a boom pivotally connected to a rotatable stanchion. The stanchion is supported on a roof by an adjustable saddle. A tether is slidably attached at one end to the boom and at the other end to a worker's safety belt or body harness.

U.S. Pat. No. 4,699,245, issued Oct. 13, 1987 to Benedet, is entitled "SAFETY DEVICE FOR WORKING AT GREAT HEIGHTS." The patent teaches a safety device comprising a fixed stanchion and a cable spooling out from it, with a traveler slidable along the cable. The cable attaches to a worker's safety belt or body harness at the end opposite the fixed stanchion.

U.S. Pat. No. 5,143,170, issued Sep. 1, 1992 to Hunt et al., is entitled "SAFETY DEVICE FOR ROOF WORK." The patent teaches a safety device comprising two spaced pairs of mating interlocking sleeper bars positionable over the cap or peak of a roof, straddling the roof. A pair of connecting bars or rods extends between the pair of spaced sleeper bars. The sleeper bars and the connector bars therefore lie flat against the roof. A cable is slidably attached at one end to one of the connector bar and at the other end is connectable to a worker's safety belt or body harness.

U.S. Pat. No. 5,522,472, issued Jun. 4, 1996 to Shuman, Jr. et al., is entitled "FALL PROTECTION SYSTEM FOR BRIDGE CONSTRUCTION." The patent teaches a fall protection system comprising a plurality of generally T-shaped cable supports securable to concrete support columns of a bridle or overpass during bridge construction. A plurality of first cables extend between the plurality of supports. A traveler is slidably attached to each of the plurality of first cables. A second cable extends from each traveler and is securable to a worker's safety belt or body harness.

U.S. Pat. No. 5,537,933, issued Jul. 23, 1996 to Ablad, is entitled "SEGMENTED SAFETY RAIL WITH A MOVABLE TROLLEY." The patent teaches a safety rail for use on a train. The safety rail comprises a plurality of rail segments connected to each other and disposed horizontally on the roof of a train car. A trolley rides on wheels on the rail segments. A cable may be attached to the trolley and, at its other end, to a worker's safety belt or body harness.

What is needed, and what is not provided by the prior art, is an overhead safety frame to which a worker can be secured while both maintaining freedom of movement for the worker and greatly reducing the possibility of tangling or cutting the line used to secure the worker to the frame. Such a frame would promote safety, convenience, and comfort for the worker, while, at the same time, increasing productivity. The present invention is directed to this combination of desirable attributes.

BRIEF SUMMARY OF THE INVENTION

The present invention provides a safety frame device for use by construction workers and others who require tethering for safety purposes while maintaining freedom of movement. The safety frame is adapted to be used with a tether or tethering device and a safety harness, the safety frame comprising:

(a) at least a pair of spaced apart legs;

(b) means for defining a plane for engagement with a surface;

(c) at least one cross-beam secured to the pair of legs;

(d) at least one traveler slidably disposed on the at least one cross-beam, the at least one traveler comprising means for securing a tethering device thereto; and (e) means for slidably attaching the traveler to the cross-beam.

Preferably, at least two independent travelers are slidably disposed on the cross-beam.

In a first embodiment of the present invention, the device has at least four spaced apart upstanding legs, the at least four legs cooperating to define the corners, or junctions, of a quadrangle; a pair of spaced apart beams, the beams being, preferably, substantially parallel, each of the pair of spaced apart beams extending between and secured to two of the legs; and at least one cross-beam extending between and secured to the pair of spaced apart beams. Preferably, four cross-beams extend between the pair of spaced apart beams substantially equally spaced between the ends thereof. Each cross-beam carries at least one traveler, which includes means for securing a tethering device thereto.

A caster is secured to each of the legs to render the device movable. An adjustable insert member is movably secured to each of the legs to adjust the height of same to be above or below each caster to render the device either movable or fixed in position, as necessary or desired. The means for defining a plane comprises the legs, casters, and insert members.

A second embodiment differs from the first embodiment, generally, in that the second embodiment is stationary and has surface-engaging base members and stabilizing bracing members rather than the insert members and wheel assemblies of the first embodiment. The device has at least two legs; at least two surface-engaging base members, each of the base members corresponding to and associated with a distinct leg; and at least two bracing members, each of the bracing members corresponding to and associated with a distinct leg and base member. The length of each bracing member is adjustable. Each leg is pivotably secured to the associated base member and to the associated bracing member. Each base member is additionally pivotably securable to the associated bracing member. The leg, base member, and bracing member may be secured to each other at various points along the extent of each. Thus, the legs are securable to the base members at a plurality of positions and angles. The base members cooperate to define the means for defining a plane. As in the first embodiment, each cross-beam carries at least one traveler, which includes means for securing a tethering device thereto.

For a more complete understanding of the present invention, reference is made to the following detailed description and accompanying drawings. In the drawings, like reference characters refer to like parts through the several views, in which:

BRIEF DESCRIPTION OF THE SEVERAL VIEWS OF THE DRAWING

FIG. 3 is a partial exploded view of the safety frame of FIG. 1;

FIG. 4 is a perspective view of the traveler of FIG. 3; and

DETAILED DESCRIPTION OF THE INVENTION

The present invention provides a safety frame device for use by construction workers and others who require tethering for safety purposes while maintaining freedom of movement. The safety frame is adapted to be used with a tether or tethering device and a safety harness, the safety frame comprising:

(a) at least a pair of spaced apart legs;

(b) means for defining a plane for engagement with a surface;

(c) at least one cross-beam secured to the pair of legs;

(d) at least one traveler slidably disposed on the at least one cross-beam, the at least one traveler comprising means for securing a tethering device to the at least one traveler; and (e) means for slidably attaching the at least one traveler to the at least one cross-beam.

Figure 1:
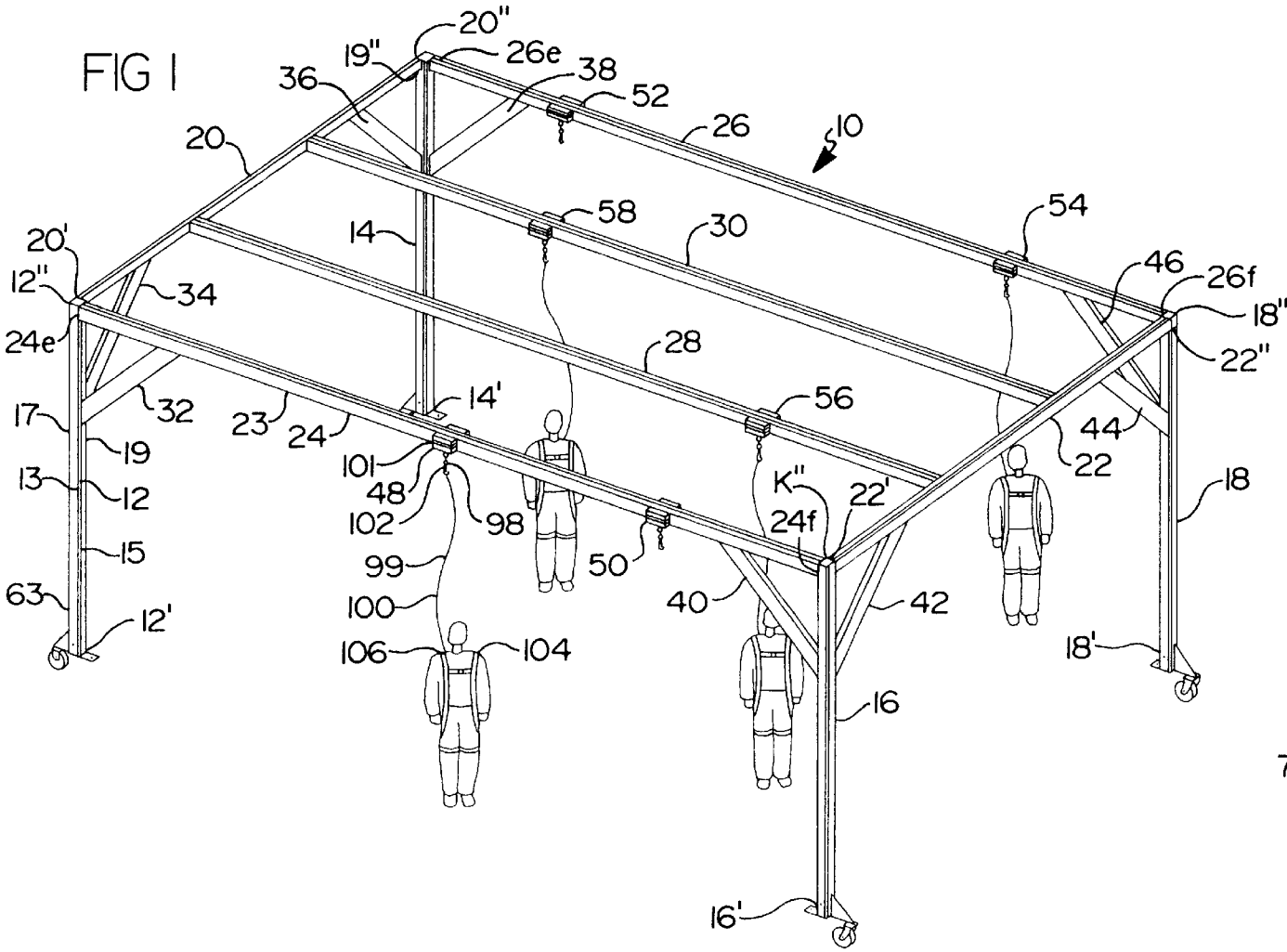
FIG. 1 is an environmental view of a first embodiment of a safety frame in accord with the present invention.

With more particularity, and referring now to FIG. 1, there is shown a first embodiment of a safety frame device in accordance with the present invention, and depicted, generally, at 10. The device 10 comprises a plurality of and at least four spaced apart upstanding legs 12, 14, 16, 18. The four legs 12, 14, 16, 18 define the corners, or junctions, of a quadrangle, preferably a rectangle, as shown. The legs 12, 14, 16, 18 are of sufficient height to provide ample clearance for persons to work under beams and cross-beams supported by the legs, as described hereinbelow, and are, preferably, the same length as each other. The preferred legs described hereinbelow are commercially available in lengths of approximately eight feet, though legs of other lengths may be used as well.

If there are more than four legs, the additional leg(s) (not shown) are, preferably, disposed between adjacent legs, i.e. 12 and 14; 14 and 16; 16 and 18; or 18 and 20, and are secured to other elements hereof as discussed below to add greater stability hereto.

Because each of the legs 12, 14, 16, 18 is similarly constructed, only the leg 12 will be used as an exemplar herein.

Figure 2:
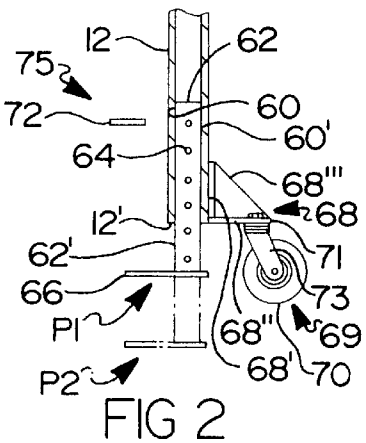
FIG. 2 is a perspective view of a leg of the safety frame of FIG. 1.

As shown in FIG. 2, the leg 12 has opposed first and second ends 12' and 12", respectively, the first end 12' being open. (The second end 12" may be open or closed.) The leg 12 is hollow and, preferably, rectangular in shape, although other geometric configurations may be used. Thus, the leg has walls 13, 15, 17, and 19, preferably arranged as the walls of a rectangle, as shown. The leg 12 has a plurality of first spaced apertures 60 and second spaced apertures 60' formed through opposite walls of the hollow leg 12 proximate the end 12'. Each of the first spaced apertures 60 is in registry through the hollow leg 12 with an associated second spaced aperture 60' to enable emplacement of an insert member, as described hereinbelow. The legs, per se, as contemplated for use are well-known and commercially available, such as those sold under the name "Profile 80×80 Heavy" by Item Product, Inc. of Houston, Tex., though other legs that allow attachment of beams, wheel assemblies, and insert members, as described hereinbelow, may be used if desired.

In a preferred embodiment hereof, a wheel assembly 68 is secured to the leg 12 proximate the end 12'. The wheel assembly 68 is, preferably, secured to a wall of the leg 12 other than the walls through which the registering apertures 60, 60' are formed, as shown in FIG. 2. The wheel assembly 68 comprises a first plate 68', a second plate 68" substantially perpendicular to the first plate 68'; and a third plate 68''' secured to both the first plate 68' and the second plate 68'' and extending therebetween. The third plate 68''' gives stability to the wheel assembly 68. The three plates 68', 68'', 68''' of the wheel assembly 68 are secured to each other by any convenient means for securing, such as by welding, threaded fasteners, or the like, or may be unitarily formed or otherwise fitted together. The first plate 68' of the wheel assembly 68 is secured to the leg 12 by any convenient means for securing, such as threaded fasteners or the like.

A caster 69 is secured to the second plate 68'' of the wheel assembly 68. The caster 69, preferably, comprises a caster plate 71, a wheel 70, and a hub 73. The caster plate 71 is secured to the second plate 68'' of the wheel assembly 68 by any convenient means for securing, such as threaded fasteners or the like. The wheel 70 is secured to the caster plate 71 opposite the second plate 68'' of the wheel assembly 68 via the hub 73 in the well-known manner. The caster 69 is, preferably, a pneumatic caster. Such pneumatic casters are well known and commercially available, such as those sold under the model number "Z72SF10627-S" by Clarklift of Detroit, Inc. As such, the pneumatic casters will not be further described herein. Alternately, a stem-type caster (not shown), which is also well known and commercially available, may be used, with the stem projecting through an aperture (not shown) in the second plate 68' of the wheel assembly 68.

The present device 10 further includes a positionable insert member 62 for controlling the transportability of the device 10. The insert member 62 is, preferably, a rectangular tube, though it may also be solid in construction and/or have other geometric configurations as desired. The insert member 62 removably projects into the hollow leg 12 from the open end 12' of the leg 12. A portion 62' of the insert member remains outside the leg 12. The insert member 62 has a plurality of spaced apertures 64 formed therethrough and therealong.

The insert member 62 further comprises a foot 66 which projects substantially perpendicularly to the leg 12 from the portion 62' of the insert member 62 that extends beyond the leg 12. The foot 66 adds stability to the device 10, as described hereinbelow, and may be used to disable the wheel 70, as described hereinbelow.

The leg 12 and the insert member 62 cooperate to define a support member 63 for the device 10. The support member 63 supports and stabilizes the device 10 in position when the insert member 62 is extended to a length beyond the caster 69 via means 75 for adjusting the length of the support member, as described hereinbelow.

The means 75 for adjusting the length of the support member comprises a removable peg 72 that fits through any pair of registering apertures 60, 60' in the leg and a selected aperture 64 in the insert member 62 to movably hold the insert member 62 to the leg 12. With the insert member 62 in a first position P1, the foot 66 is higher than the wheel 70, thereby rendering the support member 63 shorter than the combined length of the leg 12 and the caster 69. This positioning of the removable peg 72 allows the wheel 70 to contact the surface supporting the device 10, such as a roof, the ground, or a similar surface, and allowing the device 10 to be wheeled to a desired placement. With the insert member 66 in a second position P2, the foot 66 projects beyond the wheel 70, thereby rendering the support member 63 longer than the combined length of the leg 12 and the caster 69. This positioning of the removable peg 72 allows the foot 66 to contact the supporting surface such as a roof, the ground, or a similar surface, thereby stabilizing the device 10 in place.

In use, the insert member 62 may be moved from the first position P1 to the second position P2 or vice versa by lifting the leg 12, thereby relieving pressure on the peg 72; then manually removing the peg 72 from its then-current position; then moving the insert member 62 to another position; and then re-inserting the peg 72 into registering apertures 60, 60', 64.

The plurality of apertures 60, 60', and 64 in the leg 12 and the insert member 62, respectively, enable adjusting the legs 12, 14, 16, 18 to different heights by emplacing more or less of the insert members 62 within their respective associated legs 12, 14, 16, 18. In this way, the feet 66, vary in the amounts by which they project beyond the legs 12, 14, 16, 18. This is useful to allow for slope in a surface, such as a roof, upon which the device 10 is emplaced. If the device is used with a sloped surface, experience has shown that the surface should have a pitch no greater than 22.5° above horizontal to prevent the device sliding off the surface.

Alternatively, if the caster 69 is a locking caster, the caster 69 may be used to allow both rolling movement and stable placement of the device 10. Locking casters are well known and commercially available, and as such will not be further described herein. This dual use of the caster 69 is less preferred than using the foot-and-pin arrangement of the preferred embodiment to change between rolling movement and stationary placement of the device 10 because casters have a higher tendency to break than does the foot-and-pin arrangement of the preferred embodiment. Additionally, the foot-and-pin arrangement is preferred because, as noted, the foot 66 has, preferably, a larger surface area adapted to contact a supporting surface than does the wheel 70, and therefore better supports the weight of the device 10 than does the caster 69.

The legs, insert members, and casters cooperate to define the means 47 for defining a plane for engagement with a surface, such as a roof or the like. When the insert members are in a position such that the feet of the insert members extend beyond the wheels, the feet define a plane; when the insert members are in a position such that the feet do not extend beyond the wheels, the wheels define a plane.

Alternately, jacks (not shown) may be used in place of the insert members. A jack would then be permanently affixed to the bottom of each leg, and would be used to raise or lower the leg as appropriate. The jacks may be of any suitable type, such as pneumatic, hydraulic, or screw jacks. If jacks are used rather than insert members, then the jacks and the legs cooperate to define the support members, and the jacks, the legs, and the casters cooperate to define the means for defining a plane.

As shown in FIG. 1, the device 10 further comprises a pair of spaced apart, substantially parallel beams 20, 22 extending between pairs of legs 12, 14 and 16, 18 proximate their ends 12'', 14'' and 16'', 18'', respectively. The beams 20, 22 provide anchoring elements for the at least one cross-beam, as described hereinbelow. The beams 20, 22 are, preferably, rectangular in outer shape, each with a top, a bottom, and two spaced sides. The beams 20, 22 have ends 20', 20'' and 22', 22'', respectively. The beams 20, 22 are, preferably, made of heavy-duty aluminum and are constructed to utilize the well-known strength of a hexagonal shape inside the rectangular outer shape, as shown at 29 in FIG. 4 (with reference to the outside cross-beam, which is, preferably, constructed substantially similarly to the beam, as described below). Aluminum is preferred because it is lighter than steel; a hexagonal shape is preferred as an inner shape because it provides added strength. Alternatively, other metals, such as steel, may be used for the beams 20, 22. Beams of the type contemplated for use herein are well-known and commercially available, such as those sold under the name "Profile 160×40 Heavy" by Item Products, Inc. of Houston, Tex., though other beams that allow attachment of cross-beams, as described hereinbelow, may be used if desired. The beams 20, 22 are, preferably, approximately twelve feet in length, a length that is commercially available, though beams of other lengths may be used as well.

The beam 20 secures at its ends 20' and 20" to the legs 12 and 14 proximate their ends 12" and 14", respectively, by any well-known means for securing, such as threaded fasteners or the like. Similarly, the beam 22 secures at its ends 22' and 22" to the legs 16 and 18 proximate their ends 16" and 18", respectively, by any well-known means for securing, such as threaded fasteners or the like.

The device 10 further comprises at least one cross-beam 23, and preferably a pair of spaced apart parallel outside or exterior cross-beams 24, 26 and a pair of spaced apart inside or interior cross-beams 28, 30. The outside cross-beams 24, 26 cooperate with the beams 20, 22 to form a quadrangle. Preferably, the exterior and interior cross-beams are substantially equally spaced between the ends 20', 20" and 22', 22" of the beams 20 and 22, respectively.

The outside cross-beams 24, 26 are, preferably, rectangular in outer shape, each with a top, a bottom, and two spaced apart sides. Alternately, the outside cross-beams may be round or have any other suitable shape. The outside cross-beams 24, 26 have ends 24*e*, 24*f* and 26*e*, 26*f*, respectively.

Each outside cross-beam 24, 26 has a first and a second longitudinal groove 25, 27, respectively, formed therein, one on each of the two spaced apart sides of the outside cross-beam and extending along the entire length of the beam. Alternately, the grooves 25 and 27 may be formed along the top and bottom, respectively, rather than the two spaced apart sides of the outside cross-beam. The grooves 25, 27 are used in attaching the at least one traveler to the cross-beams, as described hereinbelow. The grooves 25, 27 are similarly formed; accordingly, the first groove 25 will be used as an exemplar herein.

Preferably, the first groove 25 has a narrower portion 25*n* and a wider portion 25*w*. The narrower portion 25*n* extends inwardly from one of the two spaced apart sides of the outside cross-beam 24. The wider portion 25*w* extends inwardly from the narrower portion 25*n* beyond both sides of the narrower portion 25*n*, thus approximating the outline of a mushroom cap and stem, as shown in FIG. 4. The first groove 25 is used as a track for a traveler 48, as described hereinbelow.

The outside cross-beams 24, 26 are, preferably, made of heavy-duty aluminum and are constructed to utilize the well-known strength of a hexagonal shape inside the rectangular outer shape, as shown at 29 in FIG. 4. Aluminum is preferred because it is lighter than steel; a hexagonal shape is preferred as an inner shape because it provides added strength. Alternatively, other metals, such as steel, may be used for the outside cross-beams 24, 26. Outside cross-beams of the type contemplated for use herein are well-known and commercially available, such as those sold under the name "Profile 160×40 Heavy" by Item Products, Inc. of Houston, Tex., though other outside cross-beams that enable attachment of a traveler may be used if desired.

The outside cross-beam 24 secures at its ends 24*e* and 24*f* to the legs 12 and 16 proximate their ends 12" and 16", respectively, by any well-known means for securing, such as threaded fasteners or the like. Similarly, the outside cross-beam 26 secures at its ends 26*e* and 26*f* to the legs 14 and 18 proximate their ends 14" and 18", respectively, by any well-known means for securing, such as threaded fasteners or the like. The beams 20, 22 and the outside cross-beams 24, 26 therefore form a quadrangle, preferably a rectangle, with the legs 12, 14, 16, 18 at the corners of the quadrangle and projecting normally to the quadrangle. The outside cross-beams 24, 26 are, preferably, and as commercially available, approximately eighteen feet in length, though outside cross-beams of other lengths may be used as well.

As noted, the device 10 further comprises, preferably, at least one, but even more preferably at least a pair of, spaced apart inside or interior cross-beams 28, 30. The inside cross-beams 28, 30 extend between the beams 20, 22 substantially parallel to the outside cross-beams 24, 26 and are spaced approximately equally from each other and from the outside cross-beams 24, 26. The inside cross-beams 28, 30 are secured to the beams 20, 22 by any well-known means for securing, such as threaded fasteners or the like. Each of the inside cross-beams 28, 30 is, preferably, rectangular in outer shape, with a top, a bottom, and two spaced apart sides. Alternately, the inside cross-beams may be round or have any other suitable shape. Each of the inside cross-beams 28, 30 has a pair of longitudinal grooves, substantially similar to the grooves 25, 27 in the outside cross-beam 24, for use with travelers as described hereinbelow. The inside cross-beams 28, 30 are, preferably, made of heavy-duty aluminum and are constructed to utilize the well-known strength of a hexagonal shape inside the rectangular outer shape, as shown at 29 in FIG. 4 (with reference to the outside cross-beam, which is, preferably, constructed substantially similarly to the inside cross-beam). Aluminum is preferred because it is lighter than steel; a hexagonal shape is preferred as an inner shape because it provides additional strength. Alternatively, other metals, such as steel, may be used for the inside cross-beams 28, 30. Inside cross-beams of the type contemplated for use herein are well-known and commercially available, such as those sold under the name "Profile 100×40 Heavy" by Item Products, Inc. of Houston, Tex., though other inside cross-beams that enable attachment of a traveler may be used if desired. The inside cross-beams 28, 30 are, preferably, approximately eighteen feet in length, which is a standard commercially-available length, though inside cross-beams of other lengths may be used as well.

A plurality of gussets 32, 34, 36, 38, 40, 42, 44, 46 are provided to strengthen the construction of the device 10 and prevent buckling. A selected gusset extends diagonally between the legs 12, 14, 16, 18 and the beams 20, 22 and outside cross-beams 24, 26. As shown, each gusset is placed diagonally between a leg and or beam or a leg and an outside cross-beam, and its ends are cut angularly to fit into the legs, beams, and outside cross-beams. The gussets are secured to the legs, beams, and outside cross-beams by any well-known means for securing, such as threaded fasteners or the like. The gussets are, preferably, similarly constructed to the beams 20, 22 and are of sufficient length to attach to adjacent legs, beams, and cross-beams as appropriate. The gussets 32, 34, 36, 28, 40, 42, 44, 46 are, preferably, made of heavy-duty aluminum and are constructed to utilize the well-known strength of a hexagonal inner shape, as shown at 29 in FIG. 4 (with reference to the outside cross-beam, which is, preferably, constructed substantially similarly to the gusset). Aluminum is preferred because it is lighter than steel; a hexagonal shape is preferred as an inner shape because it provides additional strength. Alternatively, other metals, such as steel, may be used for the gussets 32, 34, 36, 38, 40, 42, 44, 46. Gussets of the type contemplated for use herein are well-known and commercially available, such as those sold under the name "Profile 160×40 Heavy" by Item Products, Inc. of Houston, Tex., though other gussets may be used if desired.

Similar weight and strength considerations apply to the materials used for the legs 12, 14, 16, 18.

At least one traveler 101 is slidably attached to the at least one cross-beam 23 via means 99 for slidably attaching the at least one traveler to the at least one cross-beam. Preferably, at least one traveler is slidably attached to each outside cross-beam 24, 26 and inside cross-beam 28, 30, respectively, as shown at 48, 52, 56, and 58. Even more preferably, a pair of travelers 48, 50 is independently slidably attached to the outside cross-beam 24; another pair of travelers 52, 54 is independently slidably attached to the outside cross-beams 26; a single traveler 56 is slidably attached to the inside cross-beams 28; and another traveler 28 is slidably attached to the inside cross-beam 30, as shown in FIG. 1. Each of the travelers moves independently of each of the other travelers.

The travelers 48, 50, 52, 54, 56, 58 are all constructed alike and move alike. Accordingly, the traveler 48 and its associated means for slidably attaching it to the outside cross-beam 24 are used as exemplars herein.

As shown in FIGS. 3 and 4, the traveler 48 comprises a first slider 74, a second slider 76, and a plate 82, the plate 82 securing the two sliders 74, 76 to each other. The means 99 for slidably attaching the at least one traveler to the at least one cross-beam comprises a first connector 78 and a second connector 80. The first connector 78 connects the first slider 74 to the wall of the outside cross-beam 24 that contains the first groove 25 therein, as described hereinbelow; the second connector 80 connects the second slider 76 to the wall of the outside cross-beam 24 that contains the second groove 27 therein, also as described hereinbelow. The sliders 74, 76 are alike. Similarly, the connectors 78, 80 are alike. Accordingly, the first slider 74 and the first connector 78 will be used as exemplars herein.

The first slider 74 comprises a longitudinally coaxial pair of spools 84, 86 and a housing 88, the spools 84, 86 disposed within and secured to the housing 88, by being bolted thereto by bolts 85 or the like. The housing 88 is, preferably, rectangular in shape. A slot 90 is longitudinally formed within the housing 88, the slot 90 providing access to the spools 84, 86. The first slider 74 is, preferably, unitarily formed, though other means for securing the spools to the housing such as welding or the like may also be used. The first slider 74 is, preferably, made of heavy-duty aluminum, because of the same considerations noted above in relation to the beams. Such sliders of the type contemplated for use herein are well-known and commercially available, such as those sold under the name "Double Unit Concentric" by Item Products, Inc. of Houston, Tex., though other sliders that are slidably attachable to a cross-beam may be used if desired.

The first connector 78 comprises a tubular portion 92, an insert portion 94, and a retention portion 96, the insert portion 94 projecting longitudinally from the tubular portion 92 and the retention portion 96 projecting longitudinally from the insert portion 94 in a direction opposite the tubular portion 92, as shown.

The insert portion 94 and the retention portion 96 are emplaced in the first groove 25 in the outside cross-beam 24. As noted, the first groove 25 has a narrower portion **25*n* and a wider portion 25*w*; the insert portion 94 fits in the narrower portion 25*n* and the retention portion 96 fits in the wider portion 25*w*. The retention portion 96 of the connector 78 is wider than the narrower portion 25*n* of the first groove 25; because of this, the connector 78 cannot be pulled latitudinally out of the first groove 25, because the retention portion 96 of the connector 78 will not fit through the narrower portion 25*n* of the first groove 25**.

The tubular portion 92 of the first connector 78 engages the spools 84, 86 within the slot 90 in the housing 88 of the first slider 74. Thus, the first slider 74 can slide along the outside cross-beam 24 by the spools 84, 86 sliding along the tubular portion 92 of the first connector 78.

As noted, the second slider 76 and the second connector 80 are similarly constructed to the first slider 74 and the first connector 78, respectively. The second slider 76 and the second connector 80 cooperate with the second groove 27 in the outside cross-beam 24 similarly to the way the first slider 74 and the first connector 78 cooperate with the first groove 25 in the outside cross-beam 24.

The plate 82 secures the first slider 74 and the second slider 76 to each other. The plate 82 fits over the bottom of the outside cross-beam 24 and secures to both the first slider 74 and the second slider 76 by any well-known means for securing, such as by welding, threaded fasteners, or the like.

As noted, the traveler 48 comprises the sliders 74, 76 and the plate 82. The traveler 48 slides along the outside cross-beam 24 by the sliders 74, 76 sliding along the connectors 78, 80 that are secured to the outside cross-beam 24 via the grooves 25, 27 therein. The connectors 78, 80 and the grooves 25, 27 in the outside cross-beam 24 cooperate to define the means 99 for slidably attaching the at least one traveler to the at least one cross-beam.

As shown in FIG. 1, a U-shaped bolt 98 projects from a surface of the plate 82 opposite the sliders 74, 76, as shown. A tether or tethering device 99, which is, preferably, a lanyard 100, secures to the bolt 98 via a hook 102 or similar means in the well-known manner. Such lanyards as contemplated for use herein are well-known and are commercially available.

The preferred lanyard is retractable, which maintains tension as the wearer moves. Maintaining tension in the lanyard increases both safety and convenience for the worker. Safety is increased because, upon rapid movement, such as a fall, the lanyard locks and prevents or arrests the fall. Convenience is increased because the entire lanyard is always above the worker, i.e. between the worker and the frame, rather than any excess length of the lanyard dangling around the worker. Alternately, a non-retractable lanyard such as those sold under the name "Manyard Shock Absorbing Lanyard" by Miller Equipment may be used herein. The lanyard 100 is, preferably, fifteen feet in length, though lanyards of other lengths may be used as well. The U-shaped bolt 98 and the hook 102 cooperate to define the means for securing the tethering device to the at least one traveler 101. Alternately, a rope (not shown) may engage the U-shaped bolt 98.

In securing a user to the frame hereof, the lanyard 100 ordinarily extends to a safety harness 104 worn by a user, as shown, and secures to the harness 104 via a hook 106 in the well-known manner. Such safety harnesses as contemplated for use herein are well-known and are commercially available, such as those sold under the name "Duralite #852" by Miller Equipment. A worker may wear the safety harness 104. Thus, the worker wearing the safety harness 104 is secured to the device 10 via the lanyard 100 extending from the harness 104 to the U-shaped bolt 98 in the plate 82 of the traveler 48.

As noted, each slider 74, 76 may slide along its associated connector 78, 80. This, in turn, allows the traveler 48 to slide along the entire length of the cross-beam 24. With the cross-beam 24 being, preferably, eighteen feet in length, and the lanyard 100 being, preferably, fifteen feet in length, this gives a worker wearing the safety harness 104 secured to the lanyard 100 an area forty-eight feet in length in which to work while being tied to the device 10.

Figure 5:
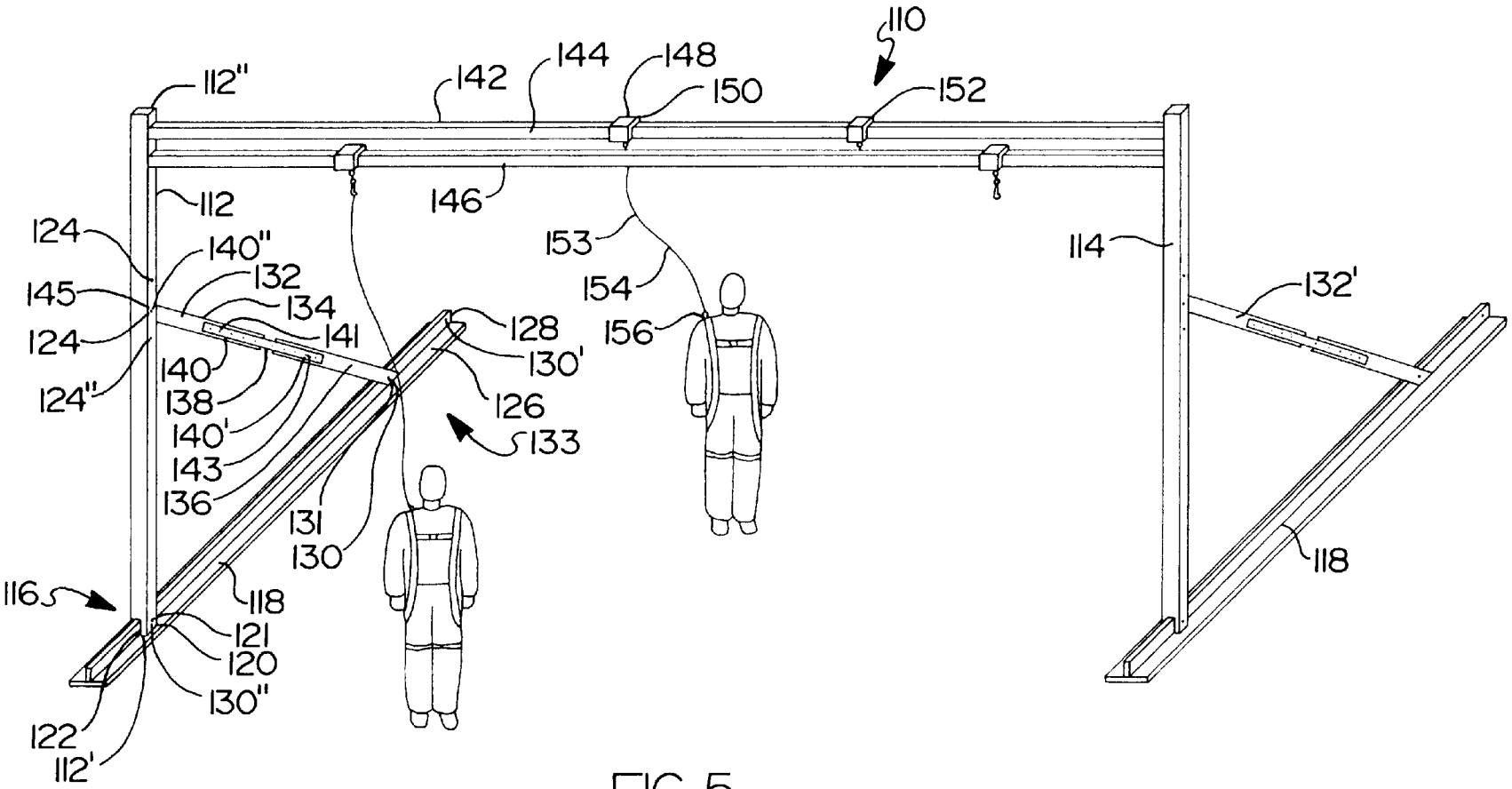
FIG. 5 is an environmental view of a second embodiment of a safety frame in accord with the present invention.

Referring now to FIG. 5, there is shown a second embodiment of a safety frame device in accordance with the present invention, and depicted, generally, at 110. The second embodiment differs from the first embodiment, generally, in that the second embodiment is stationary and has surface-engaging base members and stabilizing bracing members rather than the insert members and wheel assemblies of the first embodiment.

Several components of the second embodiment are the same as in the first embodiment, as described hereinbelow.

The device 110 comprises a plurality of, and at least two, spaced apart legs 112 and 114. The legs 112, 114 are of sufficient height to provide ample clearance for persons to work under cross-beams supported by the legs, as described hereinbelow, and are, preferably, the same length as each other. The preferred legs described hereinbelow are commercially available in lengths of approximately eight feet, though legs of other lengths may be used as well.

The legs 112, 114 are the same as each other, and thus, for purposes of brevity and clarity, only the leg 112 will be described herein. If there are more than two legs, the additional leg(s) are, preferably, the same as the legs 112 and 114, are disposed between the legs 112 and 114, and are secured to other elements hereof as discussed below to add increased stability hereto.

The leg 112 is, preferably, hollow, and is, preferably, rectangular is shape, though other geometric configurations may be used.

The leg 112 has first and second opposed ends 112' and 112", respectively. The leg 112 has at least one aperture 124, and preferably a plurality of apertures 124, 124', 124", etc., formed therethrough spaced from each end, as shown in FIG. 5. These apertures 124, 124', 124", are used in positionably and pivotably securing a bracing member 132 to the leg 112, as described hereinbelow. The leg 112 further has at least one aperture 120 formed therethrough proximate the end 112' thereof, and a groove 122 formed through the end 112'. The aperture 120 and the groove 122 are used in positionably and pivotably securing a base member or base 118 to the leg 112, as described hereinbelow, to enhance stability of the device and to cooperate in defining a plane for engagement with a surface, such as a roof or the like, as described hereinbelow. The legs, per se, as contemplated for use are well-known and commercially available, such as those sold under the name "Profile 80×80 Heavy" by Item Product, Inc. of Houston, Tex., though other legs allowing attachment of cross-beams, bases, and bracing members, as described hereinbelow, may be used if desired.

The base 118, preferably, comprises a beam of any suitable material, such as heavy-gauge aluminum, steel, or the like. The base 118 has, preferably, a T-shaped cross-section, as shown in FIG. 5, with a first leg 126 and a second leg 128 projecting substantially perpendicularly therefrom. The second leg 128 of the base 118 has a plurality of spaced apertures 130, 130', 130", etc. formed therethrough through which a removable peg 121 or 131 may be inserted. The base 118 is, preferably, eight feet in length, with the closest aperture to an end of the base being two feet from same, but bases of other lengths and alternate aperture placements may be used as desired. The bases 118, 118' are affixable to a surface, such as a roof or other surface (not shown), by any suitable means, such as by cables (not shown) being wrapped around the base members and around projections on the surface (not shown) or the like.

In use, the leg 112 is emplaced over the base 118, with the second leg 128 of the base 118 slidingly fitting into the groove 122 of the leg 112. A removable peg 121 is inserted through registering apertures 130" and 120 in the base 118 and the leg 112, respectively, thus holding the leg in place relative to the base.

The bases 118 and 118' cooperate to define the means 133 for defining a plane for engagement with a surface.

A bracing member or brace 132 extends between the leg 112 and the base 118. The brace 132, preferably, comprises a pair of spaced apart, substantially hollow end sections 134, 136 and a connecting section 138 slidably disposed within the end sections, and is formed of any suitable material, such as heavy-gauge aluminum, steel, or the like. Each of the sections 134, 136, 138 has a plurality of apertures 140, 140', 140", etc. formed therethrough. In use, the brace 132 may be rendered shorter or longer by sliding the end sections 134, 138 closer to or farther away, respectively, from each other along the connecting section 138, then inserting a removable peg 141 through registering apertures in the end section 134 and the connecting section 138 and inserting another removable peg 143 through registering apertures in the end section 136 and the connecting section 138.

To attach the brace 132 to the leg 112, the brace 132 is positioned relative to the leg 112 such that one of the apertures 140, 140', 140" in the brace 132 registers with one of the apertures 124, 124', 124", etc. in the leg 112. In FIG. 5, the registering apertures are denoted at 140" and 124. A removable peg 145 is inserted through the registering apertures 140" and 124 in the brace 132 and the leg 112, respectively, thus holding the leg 112 in place relative to the brace 132. Alternately, the brace 132 may be attached to the leg 112 by a clamp or other well-known means for attachment. To attach the brace 132 to the base 118, the removable peg 131 is inserted through registering apertures 140 and 130 in the brace 132 and the base 118, respectively, thus holding the brace 132 in place relative to the base 118. Alternately, the brace 132 may be attached to the base 118 by a clamp or other well-known means for attachment. In this manner, and in conjunction with the pegging of the leg 112 to the base 118 detailed above, the leg 112 may be braced and held in position relative to the base 118 at a plurality of positions and angles.

The device 110 further comprises at least one cross-beam 142, and preferably at least two cross-beams 144 and 146. The cross-beams 144 and 146 are the same as the cross-beams 24, 26, 28, 30 of the first embodiment, and thus the construction of same will not be detailed further herein.

Preferably, the cross-beams 144, 146 are secured to the legs 112, 114 in the same way that the cross-beams 24, 26, 28, 30 are secured to the beams 20, 22 in the first embodiment, and thus the securement of same will not be detailed further herein. The cross-beams 144, 146 are, preferably, secured to the legs 112, 114 one below the other, as shown in FIG. 5.

Alternately, the cross-beams 144, 146 may be secured to the legs by a C-clamp or the like (not shown). If the cross-beams are secured to the legs in this manner, a stop, such as a clamp (not shown), is required on each cross-beam, preferably proximate the end of the cross-beam, to stop the traveler from sliding off the end of the cross-beam. If the cross-beams are clamped to the legs such that clamps do not impede the grooves in the cross-beams, e.g. the clamps clamp to the cross-beams adjacent to the grooves but not crossing the grooves, a plurality of the safety frame devices 110 may be emplaced with the cross-beams in abutment to enable a traveler to move along a longer longitudinal distance, as described below.

The legs 112 and 114, the bases 118 and 118', the braces 132 and 132', the cross-beams 144 and 146, the removable pegs, etc. cooperate to render the entire device stable.

At least one traveler 148, and preferably at least two travelers 150, 152, are slidably disposed on each of the cross-beams 144, 146. The travelers are the same as the travelers 48, 50, 52, 54, 56, 58 of the first embodiment, and thus the construction of same will not be detailed further herein. Further, the slidable attachment of the travelers 150, 152 to the cross-beams 144, 146 is the same as the slidable attachment of the travelers 48, 50, 52, 54, 56, 58 to the cross-beams 24, 26, 28, 30 in the first embodiment, and thus will not be detailed further herein.

Each traveler is securable to a tether or tethering device 153, which is, preferably, a lanyard 154. The lanyard 154 is, in turn, is securable to a safety harness 156. The lanyard 154 and the safety harness 156 are the same as the lanyard 100 and the safety harness 104, respectively, of the first embodiment, and thus will not be detailed further herein. Further, the securement of the traveler to the lanyard and of the lanyard to the safety harness are the same as the respective securements in the first embodiment, and thus will not be detailed further herein.

In use, the bases 118, 118' are emplaced proximate an area at which worker(s) are to be secured, and are affixed thereto if desired. The legs and braces are emplaced to give securement at an optimal position and angle and are locked in place by insertion of removable pegs. Lanyard(s) are secured to the traveler(s). Worker(s) don safety jacket(s) and attach same to the lanyard(s), thus becoming movable secured to the safety frame. The independent adjustability of the positioning and angling of each of the legs relative to the associated bases, as detailed above, renders the device 110 efficacious for use on sloped surfaces as well as on horizontal surfaces. However, if the device is used on a sloped surface, experience has shown that the slope should be of no greater pitch than 450 above horizontal to prevent the device sliding off the surface.

In either embodiment, in addition to its utility as a safety device to which to secure workers on buildings and the like, the present invention is useful for a variety of other purposes. One further use is to secure workers in a wide range of occupations other than building construction who must be protected against falls into open spaces or pits. Some categories that fit this description are dock workers; bridge workers; sewer workers; automobile workers; painters; window washers; and the like.

Another further use for the present invention is as a base for a block and tackle (not shown), securing the block to the traveler via the U-shaped bolt.

Still another further use for the present invention is as a piece of play equipment. This would, preferably, entail emplacing the device 10 proximate a dropoff in terrain, such as at the top of a hill. A user would be secured to the device via the lanyard or similar tether or tethering device, then run toward the dropoff and be prevented from falling because of being secured to the frame. Other playground uses abound.

While the invention has been illustrated and described in detail in the drawings and the foregoing description, the same is to be considered as illustrative and not restrictive in character, it being understood that only the preferred embodiments have been shown and described fully and that all changes and modifications that come within the spirit of the invention are desired to be protected.

SEQUENCE LISTING

Not applicable.

What is claimed is:

1. A safety frame device that may be used with a tether or tethering device and a safety harness, the safety frame comprising:

(a) at least a pair of spaced apart legs disposed vertically;

(b) means for defining a plane for engagement with a surface;

(c) a cross-beam secured to the at least a pair of legs, said cross-beam including a vertically disposed sidewall and a longitudinally extending groove formed in said sidewall;

(d) at least one traveler slidably disposed on the cross-beam, the at least one traveler comprising a connector and means for securing a tethering device to the at least one traveler; and (e) means for slidably attaching the at least one traveler to the at least one cross-beam, said means for slidably attaching comprising said connector, said connector being slidably disposed in said groove.

2. The safety frame device of claim 1 comprising:

(a) at least four spaced apart legs, four of the legs cooperating to define the corners of a quadrangle;

(b) a pair of spaced apart beams, each of the pair of spaced apart beams extending between and secured to two of the legs; and (c) at least one cross-beam extending between and secured to the pair of spaced apart beams.

3. The safety frame device of claim 2 further comprising at least four insert members, one insert member associated with each of the legs, each leg and associated insert member cooperating to define a support member, wherein:

(a) a portion of each insert member projects into the associated leg;

(b) a portion of each insert member extends beyond the associated leg; and (c) the portion of each insert member that projects into the associated leg is positionable within the associated leg.

4. The safety frame device of claim 2 comprising at least four cross-beams extending between and secured to the pair of spaced apart beams.

5. The safety frame device of claim 3 further comprising at least four casters and four support feet, said casters being associated with and securable, respectively, to a respective one of the legs at a location proximate to an end of the respective leg, said support feet being associated with and extending transversely, respectively, from a respective insert at a location proximate to the extended end of the respective insert, and wherein the means for defining a plane comprises the support feet and the casters.

6. The safety frame device of claim 5 further comprising means for adjusting the length of the support members.

7. The safety frame device of claim 6 wherein:

(a) a plurality of spaced apart apertures are formed through each of the legs;

(b) a plurality of spaced apart apertures are formed through each of the insert members, the apertures in the insert members in registry with the apertures in the legs; and (c) the means for adjusting the length of the support members comprises at least four removable pegs, each removable peg associated with and insertable into registering apertures in one of the legs and in the insert member associated with the leg.

8. The safety frame device of claim 1 wherein the at least one traveler comprises:

(a) a pair of spaced apart sliders, each of the sliders comprising:

(i) a housing having a wall disposed vertically and an interior chamber, said wall having a slot longitudinally formed within the housing wall and communicating with said chamber;

(ii) a longitudinally coaxial pair of spools, the spools disposed within said chamber and secured to the housing, said slot providing access to the spools; and (b) a plate securing the sliders to each other.

9. The safety frame device of claim 8 wherein:

(a) the cross-beam includes a pair of opposed spaced apart vertically disposed sidewalls, each said sidewall having a groove formed along the extent of the cross-beam; and (b) the traveler further comprises a pair of spaced apart connectors, each of the connectors being slidable in an associated groove in the cross-beam, each of the connectors being secured to an associated one of the sliders and comprising:

(i) a tubular portion, the tubular portion engaging the spools through the slot in an associated one of the sliders;

(ii) an insert portion, the insert portion projecting longitudinally from the tubular portion, and (iii) a retention portion, the retention portion projecting longitudinally from the insert portion in a direction opposite the tubular portion.

10. The safety frame device of claim 9 wherein:

(a) each of the grooves has two portions, one of the portions wider than the other of the portions and the other of the portions narrower than the one of the portions, (b) the insert portion of each of the connectors is slidable in the narrower portion of an associated one of the grooves, and (c) the retention portion of each of the connectors is slidable in the wider portion of the associated one of the grooves.

11. The safety frame device of claim 1 comprising at least two travelers slidably disposed on the at least one cross-beam.

12. The safety frame device of claim 1 wherein the means for securing a tethering device to the at least one traveler comprises a U-shaped bolt.

13. The safety frame device of claim 1 further comprising:

(a) at least a pair of spaced apart base members, each leg slidingly and pivotably securable to an associated base member, (b) at least a pair of bracing members, each bracing member associated with and pivotably securable to one of the legs and one of the base members, and wherein the means for defining a plane comprises the base members.

14. The safety frame device of claim 13 wherein each of the bracing members comprises:

(a) a pair of spaced apart, substantially hollow end sections, and (b) a connecting member slidingly disposed within the end sections, wherein the end sections are slidable relative to each other and relative to the connecting section to vary the length of the bracing member.

15. The safety frame device of claim 13 further comprising means for pivotably securing each of the legs to the associated base member.

16. The safety frame device of claim 13 comprising at least two cross-beams secured to the at least a pair of legs.

* * * * *